US010285550B2

(12) United States Patent
Juergens et al.

(10) Patent No.: US 10,285,550 B2
(45) Date of Patent: May 14, 2019

(54) SUCTION NOZZLE WITH AT LEAST TWO INTERMEDIATE WALLS

(71) Applicant: Carl Freudenberg KG, Weinheim (DE)

(72) Inventors: Ralf Juergens, Laudenbach (DE); Karl-Ludwig Gibis, Limburgerhof (DE)

(73) Assignee: CARL FREUDENBERG KG, Weinheim (DE)

( * ) Notice: Subject to any disclaimer, the term of this patent is extended or adjusted under 35 U.S.C. 154(b) by 211 days.

(21) Appl. No.: 15/102,531

(22) PCT Filed: Nov. 26, 2014

(86) PCT No.: PCT/EP2014/003164
§ 371 (c)(1),
(2) Date: Jun. 8, 2016

(87) PCT Pub. No.: WO2015/086115
PCT Pub. Date: Jun. 18, 2015

(65) Prior Publication Data

US 2016/0302634 A1 Oct. 20, 2016

(30) Foreign Application Priority Data

Dec. 9, 2013 (DE) ..... 10 2013 020 935

(51) Int. Cl.
*A47L 9/02* (2006.01)
*A47L 9/06* (2006.01)
(Continued)

(52) U.S. Cl.
CPC ..... *A47L 9/0626* (2013.01); *A47L 1/02* (2013.01); *A47L 5/24* (2013.01); *A47L 7/0009* (2013.01);
(Continued)

(58) Field of Classification Search
CPC . A47L 9/0626; A47L 1/02; A47L 5/24; A47L 7/0009; A47L 7/0023; A47L 9/02;
(Continued)

(56) References Cited

U.S. PATENT DOCUMENTS 2,703,903 A 3/1955 Faith-Ell
3,002,217 A * 10/1961 McCallum ..... A47L 9/02 15/382
(Continued)

FOREIGN PATENT DOCUMENTS

CN 1636490 A 7/2005
CN 101336817 A 1/2009
(Continued)

OTHER PUBLICATIONS

International Search Report of PCT/EP2014/003164, dated Jan. 29, 2015, pp. 1-3.

*Primary Examiner* — Robert J Scruggs
(74) *Attorney, Agent, or Firm* — Leydig, Voit & Mayer, Ltd.

(57) ABSTRACT

A suction nozzle for a hard-surface suction appliance includes a base body including a suction surface to which a suction channel is connected. A suction unit can be connected on a first side of the base body which is remote from the suction surface in order to form a suction flow. The base body further includes a bottom wall, a top wall, and first and second side walls. The base body is divided into suction chambers by at least first and second partition walls.

15 Claims, 3 Drawing Sheets

(51) Int. Cl.

| | |
|---|---|
| ***A47L 1/02*** | (2006.01) |
| ***A47L 7/00*** | (2006.01) |
| ***A47L 11/40*** | (2006.01) |
| ***A47L 5/24*** | (2006.01) |

(52) U.S. Cl.
CPC ..... *A47L 7/0023* (2013.01); *A47L 9/02* (2013.01); *A47L 11/4036* (2013.01)

(58) Field of Classification Search
CPC ..... A47L 11/4036; A47L 9/242; A47L 9/06; A47L 9/0613
See application file for complete search history.

(56) References Cited

U.S. PATENT DOCUMENTS

| | | | | |
|---|---|---|---|---|
| 5,184,372 | A | 2/1993 | Mache | |
| 7,624,473 | B2 | 12/2009 | Kegg et al. | |
| 2003/0140449 | A1* | 7/2003 | Alton | A47L 9/02 15/375 |
| 2008/0028570 | A1* | 2/2008 | Cascio | A47L 5/30 15/351 |
| 2009/0070955 | A1* | 3/2009 | Hollis | A47L 7/0009 15/415.1 |

FOREIGN PATENT DOCUMENTS

| | | | |
|---|---|---|---|
| CN | 101909499 | A | 12/2010 |
| CN | 102835929 | A | 12/2012 |
| CN | 102920398 | A | 2/2013 |
| CN | 103099582 | A | 5/2013 |
| DE | 19719932 | A1 | 4/1998 |
| DE | 10302728 | A1 | 8/2004 |
| DE | 202005018081 | U1 | 4/2007 |
| EP | 2227126 | B1 | 9/2010 |
| JP | 0483156 | U | 7/1992 |
| WO | WO 2009086893 | A2 | 7/2009 |

* cited by examiner

SUCTION NOZZLE WITH AT LEAST TWO INTERMEDIATE WALLS

CROSS-REFERENCE TO RELATED APPLICATIONS

This application is a U.S. national stage application under 35 U.S.C. § 371 of International Application No. PCT/EP2014/003164, filed on Nov. 26, 2014, and claims benefit to German Patent Application No. DE 10 2013 020 935.8, filed on Dec. 9, 2013. The International Application was published in German on Jun. 18, 2015, as WO 2015/086115 A1 under PCT Article 21(2).

FIELD

The invention relates to a suction nozzle for a hard-surface suction appliance.

BACKGROUND

Suction nozzles of the type mentioned at the beginning are used for cleaning and scraping hard surfaces, in particular for cleaning and scraping tiled walls, floors, window panes, or glass doors.

Suction nozzles of this type are known from EP 2 227 126 B1. The previously known suction nozzle has a suction hood to which a suction channel is connected, wherein a suction unit can be connected to the end remote from the suction hood. The suction unit serves to form a suction flow. The suction channel has a bottom wall and a top wall which are connected to each other via side walls. Suction nozzles constructed in this way have a flow profile which cannot be altered across their cross-section, and with these suction nozzles the suction effect is usually greatest at the center of the suction nozzle. Particularly when removing fluids, streaks and smears occur at the sides of the suction nozzle at the contact region between the bottom wall of the suction nozzle and the hard surface.

SUMMARY

An aspect of the invention provides a suction nozzle for a hard-surface suction appliance, the nozzle comprising: a base body including a suction surface to which a suction channel is connected, wherein a suction unit can be connected on a first side of the base body which is remote from the suction surface in order to form a suction flow, wherein the base body further includes a bottom wall, a top wall, and first and second side walls, and wherein the base body is divided into suction chambers by at least first and second partition walls.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
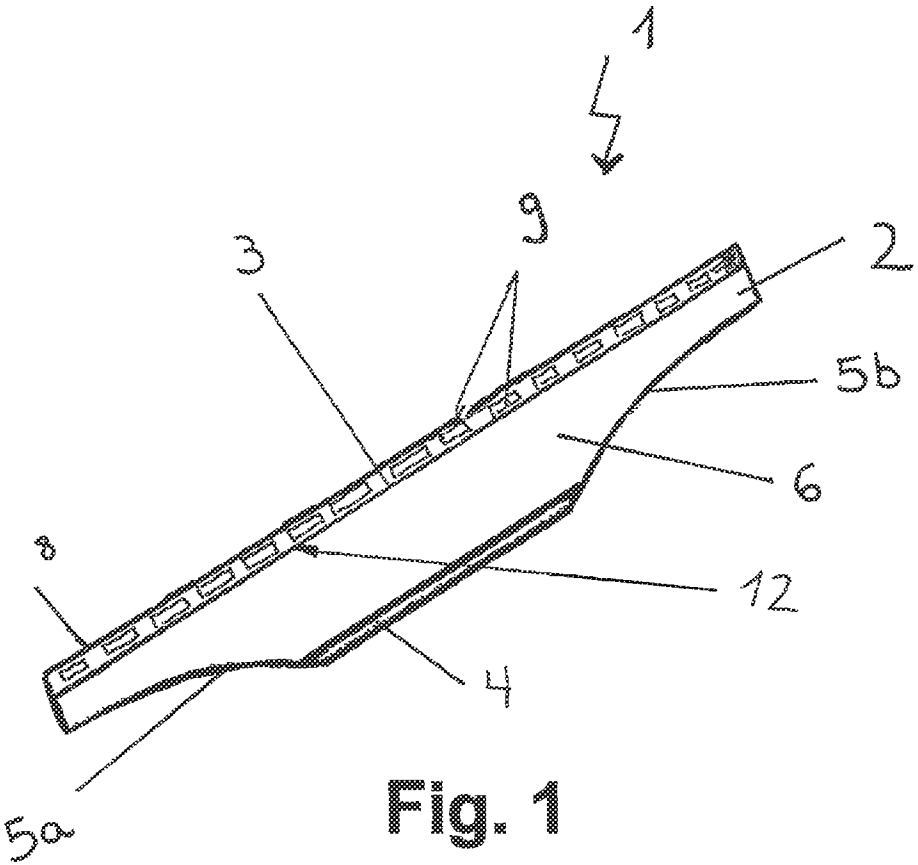
FIG. 1 shows a perspective view of the suction nozzle.

An aspect of the invention provides a suction nozzle for a hard-surface suction appliance, comprising a base body with a suction surface to which a suction channel is connected, wherein a suction unit can be connected on that side of the base body which is remote from the suction surface in order to form a suction flow, wherein the base body has bottom, top and side walls.

An aspect of the invention is to provide a suction nozzle for a hard-surface suction appliance which has a flow velocity profile which can be set specifically and/or is uniform over the entire width of the suction hood. Moreover, it is intended that, by virtue of the specifically set flow profile, a suction unit with the lowest possible power can be used.

An aspect of the invention provides a generic suction nozzle by the base body being divided into suction chambers by at least two partition walls.

According to an aspect of the invention, it has been recognized that multiple suction chambers can be formed by dividing the base body using partition walls. This enables different flow velocities to be set along the suction surface, as a result of which the cleaning power of the suction nozzle can be improved.

The suction nozzle could have a suction hood which is wider than a transition piece to the suction unit. However, flow paths of different lengths could occur as a result.

The flow resistance of the flow paths in the suction chambers can advantageously be homogenized by the partition walls.

Moreover, suction channels can be formed by the partition walls in the suction chambers.

The geometry of the suction chambers could be chosen such that a predetermined flow velocity profile can be set. The flow velocity profile is preferably set in such a way that an increased flow velocity prevails at the side walls of the suction nozzle, as a result of which the cleaning power of the suction nozzle can be improved specifically in the edge region.

It could be possible for different flow velocities to be set in the suction chambers. Optimal distribution of the flow velocity over the width of the suction surface is thus possible.

The suction hood preferably has a lower flow resistance at the sides. The flow velocity is increased as a result.

According to a further preferred embodiment of the invention, the flow velocities at the suction hood are the same. This results in a uniform distribution of the suction power over the entire width of the suction surface.

The partition walls are preferably arranged in a fan shape. Such an embodiment reduces the formation of vortices, as a result of which a lower flow resistance is achieved.

The partition walls could also be arranged in a wave or zigzag shape. The formation of vortices and the flow resistance can be reduced as a result.

The partition walls could be spaced apart differently from each other. This allows optimal setting of the flow velocity at the suction surface, in particular at the side walls of the suction nozzle, and the flow resistance can be set at an outlet surface remote from the suction surface.

The spacing between the partition walls at the suction surface could be greater than on the opposite side. This causes a wider suction surface, as a result of which large-surface cleaning is enabled.

According to a further embodiment, the spacing between the partition walls at the suction surface could be equidistant. The spacing between the partition walls at the suction unit can be greater in the case of the lateral channels than in the case of the central channels. The flow resistance in all the channels can thereby be homogenized. This results in a uniform distribution of the suction power over the entire width of the suction surface.

The suction nozzle could have recesses, rectangular in cross-section, at the suction surface. The flow velocity can be set according to the width and the length of the rectangular recesses in cross-section at the suction surface. The cross-section at the suction surface could be smaller than at an outlet surface remote from the suction surface, as a result of which a higher inlet velocity is achieved.

According to a preferred embodiment, at least one scraper lip is provided. Fluid can be stripped off the hard surface particularly easily with the aid of the scraper lip.

A sealing lip could have recesses. These serve as a diffuser element. The fluid that is scraped off passes into the suction nozzle in the course of the movement of the suction nozzle over the hard surface which is to be cleaned.

The suction nozzle is preferably used in an arrangement. This arrangement could comprise a suction nozzle, a suction unit for forming a suction flow, and a dirty fluid tank. This allows hygienic and time-saving cleaning of hard surfaces without the formation of streaks and smears. The sucked-up fluid and the sucked-up particles of dirt are collected in the dirty fluid tank. The suction unit serves to generate a reduced pressure, as a result of which a suction flow is formed. A fluid/air mixture can be sucked in as a result of the suction flow formed. The dirty fluid tank can preferably be releasably connected to the suction nozzle.

The suction nozzle could be used in a hard-surface suction appliance, in particular in a handheld hard-surface suction appliance. Owing to the adjustable flow velocities in the suction nozzle, the latter is extremely well-suited for cleaning large areas of smooth hard surfaces such as, for example, for cleaning windows, mirrors, or tiles. The suction nozzle in a hard-surface suction appliance is moreover extremely well-suited for removing particles of dirt and fluids from a hard surface.

FIG. 1 shows a suction nozzle 1 for a hard-surface suction appliance, comprising a base body 2 with a suction surface 3 to which a suction channel is connected, wherein a suction unit can be connected at one side 4 of the base body 2, remote from the suction surface 3, in order to form a suction flow, wherein the base body 2 has a bottom wall 7, a top wall 6, and side walls 5*a*, 5*b*.

The suction nozzle 1 has recesses 9 which are rectangular in cross-section on the suction surface 3.

The suction nozzle 1 is provided with a sealing lip 8 and a scraper lip 12.

Figure 2:
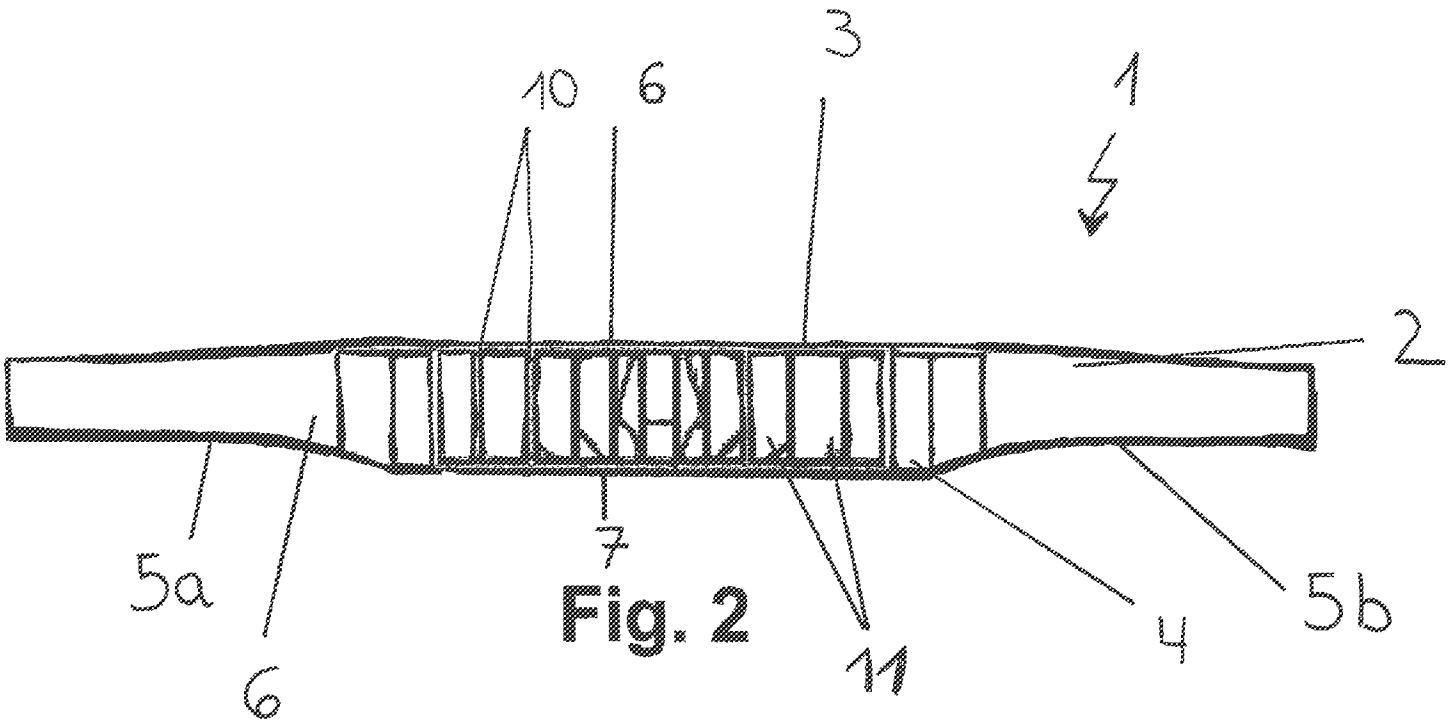
FIG. 2 shows a plan view of the suction nozzle.

FIG. 2 shows a plan view of the suction nozzle 1 shown in FIG. 1. According to a preferred embodiment, the base body 2 is divided into suction chambers 11 by partition walls 10.

The geometry of the suction chambers 11 is chosen such that a predetermined flow velocity profile can be set. Different flow velocities can be set within the suction chambers 11. The suction chambers 11 are trapezoidal in design.

The partition walls 10 are spaced apart differently from each other.

The suction nozzle 1 shown can be used, for example, in a hard-surface suction appliance.

Figure 3:
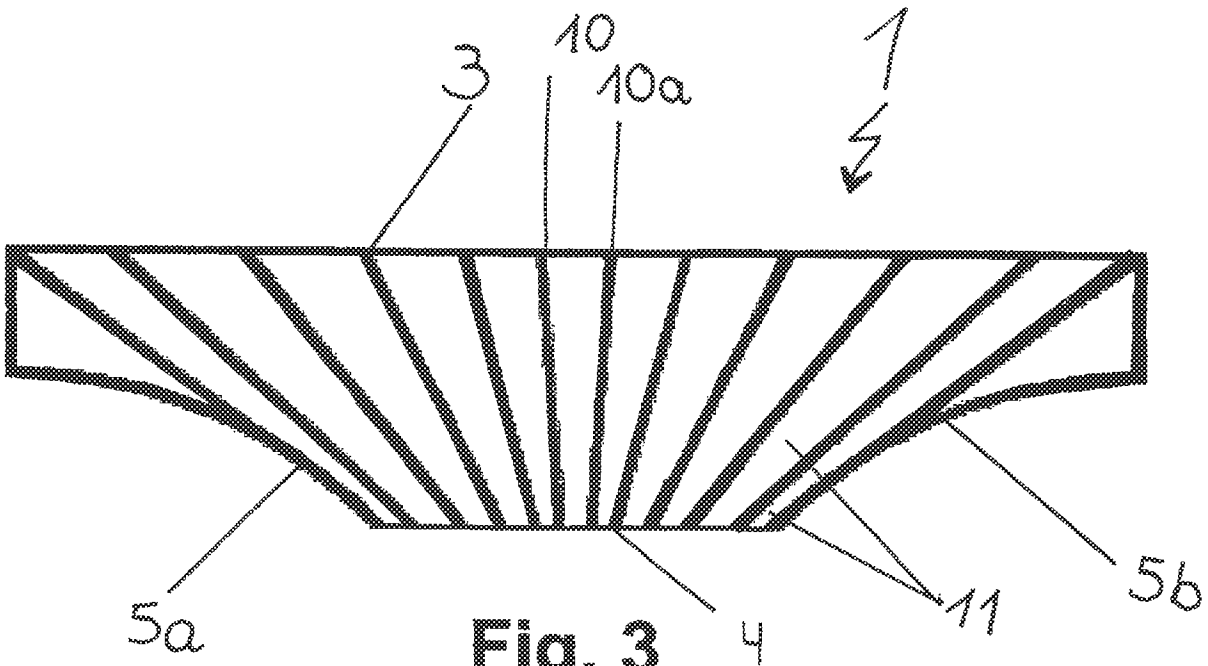
FIG. 3 shows a view in section of the suction nozzle.

FIG. 3 shows a view in section of the suction nozzle 1.

It can be seen that the partition walls 10 are arranged in a fan shape. The partition walls 10 are arranged obliquely with respect to the central partition wall 10*a*.

The spacing between the partition walls 10 on the suction surface 3 is greater than on the opposite side. The partition walls 10 run in straight lines, as a result of which the formation of vortices is prevented.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A suction nozzle for a hard-surface suction appliance, the nozzle comprising:

a base body including a suction surface to which at least one suction channel is connected; and at least one scraper lip, wherein a suction unit can be connected on a first side of the base body which is remote from the suction surface in order to form a suction flow, wherein the base body further includes a bottom wall, a top wall, and first and second side walls, wherein the base body is divided into suction chambers by at least first and second partition walls so as to form at least one central suction channel and at least two lateral suction channels, wherein spacing between partition walls at the first side of the base body is greater for the at least two lateral suction channels than for the at least one central channel, and wherein the at least first and second partition walls extend from, and contact, both the suction surface and the first side of the base body.

2. The nozzle of claim 1, wherein a geometry of the suction chambers is configured such that a predetermined flow velocity profile can be set.

3. The nozzle of claim 1, wherein different flow velocities can be set in the suction chambers.

4. The nozzle of claim 1, wherein flow velocities along the suction surface are the same.

5. The nozzle of claim 1, wherein the at least first and second partition walls are arranged in a fan shape.

6. The nozzle of claim 1, wherein spacing between partition walls on the suction surface is greater than on the first side of the base body.

7. The nozzle of claim 1, wherein spacing between neighboring partition walls at the suction unit increases toward the outside.

8. The nozzle of claim 1, further comprising:

recesses on the suction surface, which recesses are rectangular in cross-section.

9. The nozzle of claim 1, further comprising:

a sealing lip.

10. The nozzle of claim 9, wherein the sealing lip includes a recess.

11. The nozzle of claim 9, wherein the sealing lip includes two or more recesses.

12. An arrangement, comprising:

the nozzle of claim 1;

a suction unit configured to form a suction flow; and a dirty fluid tank.

13. A hard-surface suction appliance, comprising:

the nozzle of claim 1.

14. The nozzle of claim 1, wherein all partition walls are arranged in a fan shape.

15. The nozzle of claim 1, wherein spacing between all partition walls on the suction surface is greater than on the first side of the base body.

* * * * *